US005447233A

United States Patent [19]

Smith

[11] Patent Number: 5,447,233

[45] Date of Patent: Sep. 5, 1995

[54] CORNER PROTECTOR FOR PICTURE FRAMES AND THE LIKE

[76] Inventor: Steven H. Smith, 8759 Jay Ct., Arvada, Colo. 80003

[21] Appl. No.: 136,366

[22] Filed: Oct. 15, 1993

[51] Int. Cl.[6] ..... B65D 85/30; A47B 95/00

[52] U.S. Cl. ..... 206/453; 40/159.1; 206/523; 206/586; 248/345.1

[58] Field of Search ..... 206/453, 586, 521, 523; 40/159.1; 248/345.1

[56] References Cited

U.S. PATENT DOCUMENTS

| | | | |
|---|---|---|---|
| 1,326,139 | 12/1919 | Riley | 40/159.1 |
| 1,976,607 | 10/1934 | Engel | 40/159.1 |
| 3,302,782 | 2/1967 | Pezely, Jr. | 206/453 |
| 3,870,152 | 3/1975 | Kaplan | 206/523 |
| 3,960,354 | 6/1976 | Simikoski | 206/586 X |
| 4,496,054 | 1/1985 | Koltun | 206/586 |
| 5,071,009 | 12/1991 | Ridgeway | 206/586 |

*Primary Examiner*—Bryon P. Gehman
*Attorney, Agent, or Firm*—Charles C. Corbin

[57] ABSTRACT

Disclosed is a corner protector used for packing framed pictures, mirrors, and the like, the protector formed of a single block of expanded polystyrene-like lightweight material and having an upright and a horizontal external wall, spaced-apart parallel side walls, and a forward wall that inclines at 45° to the upright and horizontal walls. A shaped cavity for receiving the corner of the framed article is provided in the inclined wall, the cavity characterized by a tiered structure of progressively wider slots.

2 Claims, 1 Drawing Sheet

CORNER PROTECTOR FOR PICTURE FRAMES AND THE LIKE

BACKGROUND OF THE INVENTION

1. Field of the Invention

The present invention relates to corner protectors, and in particular to protectors for corners of picture frames and like articles.

2. Description of the Prior Art

The conventional way of packing a framed picture or mirror to protect it against damage during shipping and storage, is to surround the framed article in a shipping box with large amounts of crumpled newsprint, or by wrapping it in paper pads. Unfortunately such traditional methods have many drawbacks and limitations. For example, although used newsprint may be readily available, the handling and crumpling of newsprint make it a labor-intensive and time-consumptive chore, and the crumpled paper unfortunately offers very little shock absorption despite the relatively large volume that is customarily employed. A further unfortunate aspect of traditional packing methods is that paper is seldom reused or recycled.

In an effort to provide packing for four-cornered, generally flat rectangular articles, corner protectors have been devised, including various ones of foldable paper board as are shown in U.S. Pat. Nos. 4,598,825, 4,385,698, 4,134,496, 4,143,766. Unfortunately these prior art designs do not adequately address the requirements of packing framed pictures and mirrors, and like articles, in particular do not accommodate a wide variety of sizes and styles of frames.

SUMMARY OF THE INVENTION

In view of the foregoing, it is a general object of the present invention to provide improved means for packing framed pictures, mirrors and like articles for shipment and storage.

Another object of the invention is to provide for the packing of such articles in a way that is highly effective at cushioning the article within a shipping box, and which is considerably less labor intensive than traditional packing methods.

Yet another object is to provide corner protectors that are low-cost and reusable.

Still another object of the invention is to provide a packing system by which a framed article can be suspended within the middle of a shipping carton, so as to keep it spaced from contact with the walls of the carton.

A yet further object of the invention is to provide such a corner protector that can accommodate a wide variety of sizes and styles of framed articles.

These, and other objects and advantages can be provided by the system of the present invention which features a corner protector for framed articles wherein each frame corner includes two substantially planar parallel faces and two adjacent edge faces at right angles to each other. The corner protector has a body of expanded polystyrene-like material having spaced-apart external opposite sidewalls, a horizontal bottom wall and a vertical back wall, and an inclined front wall that lies at 45° to the bottom and back walls. There is a shaped cavity in the front face for receiving article corners of differing widths, and it is characterized by a tiered structure including a central slot that has a vertical wall for abutting the vertical edge of the framed article corner, and a horizontal surface for abutting the horizontal edge of the framed article corner. The cavity includes a second, intermediate article corner-receiving slot that is substantially greater in width than the central slot and includes a pair of vertical co-planar abutment surfaces, spaced apart on opposite sides of the central slot, the intermediate slot further including a pair of co-planar horizontal abutment surfaces, also spaced apart on opposite sides of the central slot. Finally, there is at least a third article corner-receiving slot substantially wider than the intermediate slot, and it also has a pair of vertical co-planar abutment surfaces and a pair co-planar horizontal abutment surfaces, these horizontal and vertical surfaces spaced on opposite sides of the intermediate slot. Each slot has a depth relative to the inclined front wall, and the intermedite slot is shallower than the central slot, and the third slot shallower than the intermediate one, and the overall tiered structure of the cavity is effective to receive article corners of differing thicknesses and styles. In a preferred embodiment a relatively shallow groove extends centrally along the outside of the protector such that a holding strap can be engaged in the grooves to hold four protectors engaged with the corners of a framed article, and to hold the article substantially centered with respect to the walls of a shipping carton.

DETAILED DESCRIPTION OF THE INVENTION

Figure 1:
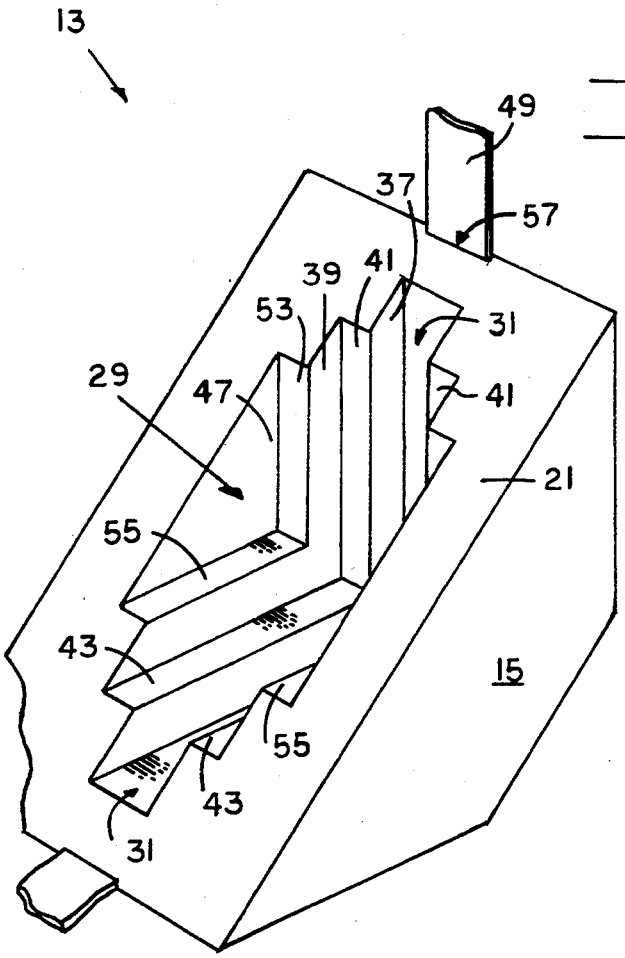
FIG. 1 is a perspective view of a preferred embodiment of a corner protector according to the present invention.
Figure 2:
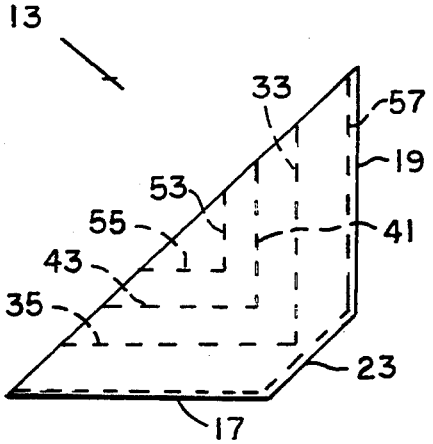
FIG. 2 is a side elevational view, with parts broken away for clarity, of a corner protector according to the present invention.
Figure 3:
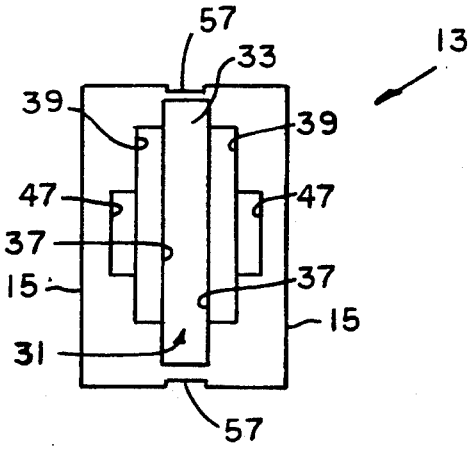
FIG. 3 is a front elevational view of the protector of FIG. 2.

Referring now to the drawings, FIGS. 1, 2 and 3 show a preferred embodiment of a corner protector 13 according to the present invention that is molded of a lightweight expanded polystyrene material, or similar molded cushioning material, including molded or and expanded polyethylene. Protector 13 has spaced-apart opposite outside walls 15, a bottom wall 17 a back wall 19 and an intermediate wall 23. There is an inclined front wall 21 that lies at 45° to walls 17 and 19, and which is provided with a corner-receiving cavity 29 that features a tiered structure for application to corners of frames for pictures, mirrors, and the like, including frames of a variety of different styles and thicknesses, as will be appreciated.

The cavity 29 is comprised of three slots of differing widths. There is a central slot 31 that is bounded by vertical wall 33 and horizontal wall 35 which are designed to abut adjacent edges of a frame to hold the frame corner with respect to vertical and horizontal movement, central slot 31 further including the spaced-apart mutually facing side walls 37, and as best shown in FIGS. 2 and 3, the spacing between opposite walls 37 being selected such that any of a variety of frames that can fit between walls 37, the walls 37 being designed to abut opposite generally planar parallel sides of a frame corner to hold the frame against relative lateral movement. It is to be understood that the descriptive term "generally planar" includes ornamental curved surfaces commonly found on some frames.

Protector 13, by way of cavity 29, can also accommodate within a range of thicknesses, frames that are too wide to be received in slot 31. This is accomplished by an intermediate slot that is bounded by the opposite, mutually facing parallel sides 39, a pair of coplanar vertical, forward facing walls 41, and the intersecting pair of horizontal, upward facing walls 43. It will be seen that the upward facing walls 43 are adapted to abut one edge of a frame corner, and the forward facing walls 41 are for engaging the other edge of the frame.

The cavity 29 further includes a third corner-receiving slot that has side walls 47 that are spaced apart by a distance sufficient to accommodate the corners of frames that fall in a range of sizes wider than the aforedescribed intermediate slot. Accordingly the vertical, front-facing pair of co-planar walls 53 will abut one of the edge faces of such frames and the upward-facing walls 55 will abut the other edge faces of such frames. Although the preferred embodiment herein-described has an arrangement of three corner-receiving slots, the invention also contemplates variants that would have more than three distinct slots.

Note that the protector 13 is provided with a strap-locating groove 57 that extends along the outside walls 17, 23 and 19, as best shown in FIG. 2.

Figure 4:
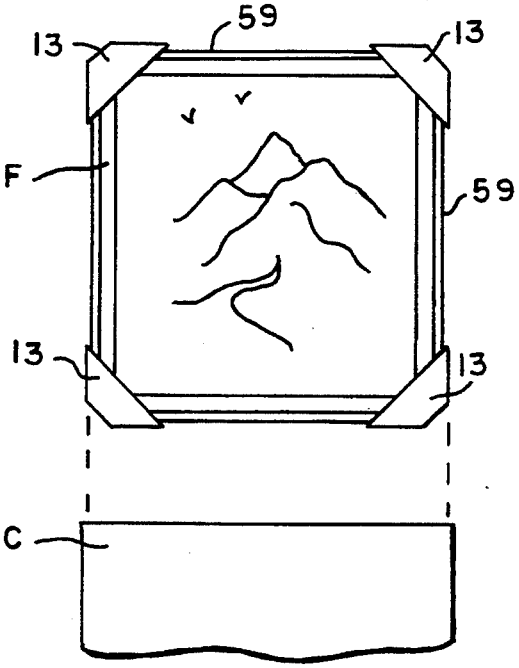
FIG. 4 is a front elevational view illustrating application of corner protectors according to the invention to a framed article.

FIG. 4 illustrates application of corner protectors 13 in a packing system for a framed article having a frame F. Here a corner protector 13 is applied over each of the four corners of frame F. A strap 59 of polypropylene or similar material can then be engaged in the locating grooves of the four protectors and drawn in a loop that is constricted so as to hold the four protectors firmly in place. Various conventional means such as a plastic buckle are available for securing the strap. When a frame F is so secured, the corner-protected assembly can be inserted in a shipping container C, such that the framed article is supported centrally within the container, with respect to the walls, not shown, of the container.

While one preferred embodiment of the invention has been disclosed, it is not intended that the invention be limited thereto, as various modifications may readily occur to those of ordinary skill in the art, given the benefit of this disclosure. Thus the invention is to be given the full breath and scope as defined in the claims which follow:

What is claimed is:

1. A corner protector for the corner of an article, the corner having two substantially planar faces and a vertical edge face that is perpendicular to a horizontal edge face, said protector comprising:

a. a body of expanded polymeric material with spaced-apart external opposite side walls, a horizontal bottom wall and a vertical back wall, and a front wall that lies at 45 degrees to said body bottom and back walls;

b. a shaped cavity that opens to said front wall, for receiving a said article corner, and characterized by a tiered structure that includes a central slot that has a vertical wall for abutting the vertical edge face of said article corner and a horizontal surface for abutting the horizontal edge face of said article corner;

c. an intermediate article corner-receiving slot having a substantially greater width than said central slot with two vertical co-planar surfaces for abutting the vertical edge face of a said article corner, and a pair of co-planar horizontal surfaces for abutting the horizontal edge face of said article corner, said co-planar horizontal surfaces spaced a predetermined distance forward of said vertical wall of said central slot, and said co-planar horizontal surfaces spaced a predetermined distance above said horizontal surface of said central slot; and d. at least a third article corner-receiving slot substantially wider than said intermediate slot, and having a pair of vertical spaced-apart co-planar surfaces for engaging the vertical edge face of a said article corner, and a pair of spaced-apart co-planar horizontal surfaces for engaging the horizontal edge face of said article corner, said pair of vertical surfaces of said third slot spaced a predetermined distance forward of said vertical surfaces of said intermediate slot, and said horizontal surfaces of said third slot spaced a predetermined distance above said horizontal surfaces of said intermediate slot.

2. A corner protector as defined in claim 1 wherein said cavity is bilaterally symmetrical about a vertical plane that is parallel to said opposite side walls, and extending through the middle of said central slot.

* * * * *